US006108849A

United States Patent [19]

Weihrauch

[11] Patent Number: 6,108,849

[45] Date of Patent: Aug. 29, 2000

[54] TOOTHBRUSH HAVING A RESILIENT NECK AND CONICAL BRUSH BUNDLES

[75] Inventor: Georg Weihrauch, Wald-Michelbach, Germany

[73] Assignee: Coronet-Werke GmbH, Wald-Michelbach, Germany

[21] Appl. No.: 09/029,746

[22] PCT Filed: Aug. 15, 1996

[86] PCT No.: PCT/EP96/03598

§ 371 Date: Mar. 2, 1998

§ 102(e) Date: Mar. 2, 1998

[87] PCT Pub. No.: WO96/03598

PCT Pub. Date: Mar. 13, 1997

[30] Foreign Application Priority Data

Sep. 8, 1995 [DE] Germany ..... 195 33 144

[51] Int. Cl.[7] ..... A46B 9/04

[52] U.S. Cl. ..... 15/167.1; 15/176.4; 15/DIG. 5

[58] Field of Search ..... 15/167.1, DIG. 5, 15/176.4

[56] References Cited

U.S. PATENT DOCUMENTS

| | | | |
|---|---|---|---|
| 958,371 | 5/1910 | Danek | 15/167.1 |
| 1,796,001 | 3/1931 | Church | 15/167.1 |
| 2,317,485 | 4/1943 | Rider | 15/167.1 |
| 4,356,585 | 11/1982 | Protell et al. | 15/167.1 |
| 4,520,526 | 6/1985 | Peters | 15/167.1 |
| 5,315,732 | 5/1994 | Huefner et al. | 15/167.1 |
| 5,323,504 | 6/1994 | McCusker | 15/167.1 |
| 5,396,679 | 3/1995 | Brown et al. | 15/176.4 |
| 5,398,367 | 3/1995 | Lu | 15/167.1 |
| 5,511,275 | 4/1996 | Volpenhein et al. | 15/167.1 |

FOREIGN PATENT DOCUMENTS

| | | | |
|---|---|---|---|
| 0 023 407 | 2/1981 | European Pat. Off. . | |
| 0 716 821 | 6/1996 | European Pat. Off. . | |
| 2502918 | 10/1982 | France | 15/167.1 |
| 4211811 | 10/1993 | Germany | 15/167.1 |
| 44 35 888 | 4/1996 | Germany . | |
| 2178304 | 2/1987 | United Kingdom | 15/167.1 |
| 88/06417 | 9/1988 | WIPO | 15/167.1 |
| 94/06324 | 3/1994 | WIPO | 15/167.1 |

*Primary Examiner*—Theresa T. Snider
*Attorney, Agent, or Firm*—Antonelli, Terry, Stout & Kraus, LLP

[57] ABSTRACT

A toothbrush in accordance with the invention includes a plastic brush body having a head, a neck and a handle, as well as bristle bundles fixed to the head, the free ends of the bristles of at least part of the bundles are located on an approximately conical envelope surface with a cone angle α of 30 to 90° and the neck of the brush body in the case of an application force K between 500 to 1200 grams acting on the bristles resiliently to give way with the cone angle α and the application force K being approximately inversely proportional.

11 Claims, 3 Drawing Sheets

TOOTHBRUSH HAVING A RESILIENT NECK AND CONICAL BRUSH BUNDLES

BACKGROUND OF THE INVENTION

1. Field of the Invention

The invention relates to a toothbrush comprising a plastic brush body having a head, a neck and a handle, as well as bristle bundles fixed to the head.

2. Description of the Prior Art

Toothbrushes are mainly used for cleaning teeth and interdental spaces, but frequently also exert a massaging action on the gingiva or the marginal area thereof. These two sought effects of a toothbrush run counter to one another. Whereas the cleaning of the teeth requires a strong brushing action, particularly in order to remove plaque or free the interdental spaces from food residues, the massaging of the gingiva must take place with restraint to avoid injuries (lesions).

Further contrary demands result from the fact that the bundles or bristles must be stiff enough to penetrate adequately deep into the interdental spaces when pressed on the tooth surfaces, but the gingiva is particularly sensitive in the interdental space. In addition, in certain cases dental neck sensitivity problems arise.

It is known that the cleaning action of a toothbrush can be increased by the ends of the bundle not being in one plane and instead arranged in stepped manner (U.S. Pat. Nos. 5,446,940 and 5,419,001), so as to ensure that all the bristles are in cleaning engagement with the tooth surfaces and interdental spaces and also penetrate all depressions when brushing the masticatory surfaces. This leads to a very complicated bristle facing topography and the manufacture of such toothbrushes is expensive. They are completely unsuitable for massaging the gingiva, because only few bundles have an action when brushing.

In addition, toothbrushes with V-shaped bundles are known, as are those with bundles having the free ends of the bristles on a conical surface (DE 37 44 630). This in particular aids the penetration of the bundle tips in the interdental spaces, but at the same time the abrasion on the tooth and the dental neck and the injury risk on the gingiva (lesions) are increased. Knowing this disadvantage, in the known toothbrush only a centrally bristle bundle is made conical and also by means of a spring is mounted in a bore on the head of the brush body. Such a construction in no way satisfies modern hygienic requirements, because oral hygiene agent and other dirt residues are deposited in the bore. An effective cleaning of the toothbrush is impossible, so that after a short time the spring action is lost due to deposits.

It is finally known (EP 613 636) to make the neck of a toothbrush resilient, so as to avoid an excessive pressing force on the part of the bristles, namely independently of the contouring of the bristle bundle. At the same time it must be ensured that the bristle head gives way on reaching a given pressing force limit. The same aim is to be achieved in another toothbrush (DE 42 11 811) in that the head and neck of the toothbrush on the brush body are mounted about the longitudinal axis thereof and on exceeding the limit turn round the longitudinal axis, so that the bristles are disengaged. However, here again no account is taken of the effectiveness of cleaning and the massaging action.

The problem solved by the invention is the construction of a toothbrush so that in the case of a completely satisfactory cleaning action on all the tooth surfaces and in the interdental spaces, it is also possible to bring about a restrained massaging of the gingiva and avoid abrasions on the tooth and dental neck and lesions on the gingiva.

This solution is provided by a toothbrush comprising a plastic brush body having a head, a neck and a handle, as well as bristle bundles fixed to the head, in that the free ends of the bristles of at least part of the bundles are located on an approximately conical envelope surface with a cone angle $\alpha$=30 to 90° and the neck of the brush body in the case of an application force K–500 to 1200 grams acting on the bristles gives way in resilient manner, and the application force being the greater the smaller the cone angle $\alpha$ is.

On applying the toothbrush the longer bristles of the conical bristle bundles give way in the interdental spaces and clean the tooth surfaces facing each other, whereas the shorter bristles ensure an adequate cleaning of the outer and inner tooth surfaces respectively. In the case of the greater pressure the bundles give way. The bristles engaging with the tooth surfaces then have a scraping effect with their circumferential surface, whereas the reshaped bristles continue to act in the interdental spaces. In the case of an excessive application force the neck of the toothbrush resiliently gives way, so that the pressure on the teeth or gingiva cannot be further increased. This protects the teeth against abrasions and the gingiva against injuries.

The spring tension of the neck is chosen as a function of the desired cone angle of the bristle bundles in such a way that the neck gives way all the more the greater the cone angle is. Therefore the cone angle and pressing force have an approximately inversely proportional relationship.

Preferably the bristle bundles have a cone angle between 50 and 70° and the neck is so designed that it gives way with an application force between 700 and 900 grams.

The application force can be set in different ways, e.g. by a corresponding configuration of the cross-section of the neck and consequently its moment of inertia. The bending strength of the neck can be influenced by the nature of the plastic. It is also possible to position, e.g. insert or integrate a spring on the neck. These measures can naturally also be combined. It is also possible to adjust the application force to the physiological requirements of the user, e.g. the force will be made lower for children than for adults. In the same way account will be taken of users having sensitive or less sensitive dental necks or gums.

In all cases the free ends of the bristle should be spherically and preferably hemispherically rounded.

The action of the bundles can also be influenced by their cross-section. For example, the bundles can have a circular, oval or polygonal cross-section.

In the same way the cleaning action can be influenced by a different stiffness or hardness of the bristles of an individual bundle or one bundle compared with the others.

It is finally advantageous if the bundles are located on a carrier or support, which is interchangeably fixed to the head, so that in the case of wear only the carrier or support with the bundles has to be replaced, which leads to an environmentally protecting construction.

Another preferred construction is characterized in that the head tapers conically or in wedge-shaped manner towards its free end, so that in particular confined or difficultly accessible areas in the oral cavity can be reached.

BRIEF DESCRIPTION OF THE DRAWINGS

Further features and advantages of the invention can be gathered from the following description of an embodiment with reference to the drawings, wherein show.

DESCRIPTION OF THE PREFERRED EMBODIMENTS

Figure 1:
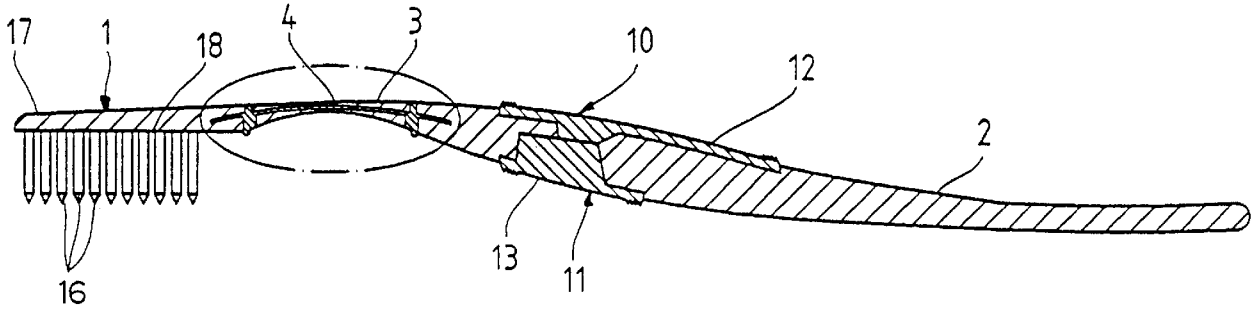
FIG. 1 A longitudinal section through a toothbrush.
Figure 3:
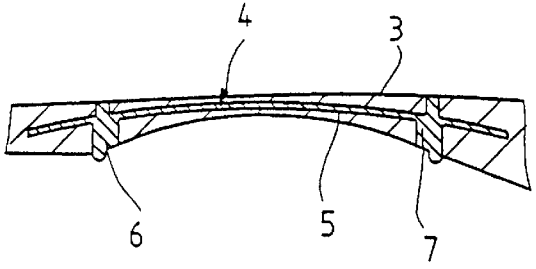
FIG. 3 A larger scale view of the neck of the toothbrush in area III of FIG. 1.

The toothbrush of FIG. 1 comprises a head 1 and an elongated handle 2, which are interconnected by means of a slender neck 3. In the represented embodiment, a spring part 4 is embedded in the vicinity of the neck 3. The toothbrush can be produced by injection moulding and the spring part 4 is also moulded. In the represented embodiment the spring is surrounded on all sides by plastic. As shown in FIG. 3, the spring part 4 has a flat, lamellar main part 5, which is provided in the vicinity of its ends with projections 6, 7 running transversely to its extension. These projections can be used for anchoring the spring part in the moulded plastic. They preferably project to the surface of the neck 3 and on their surface can additionally act as information carriers. As a result of the lamellar construction of the main part 5, it is ensured that the neck essentially only resiliently gives way in the plane corresponding to the intermediate plane and not transversely thereto.

In its thickened central area, the handle 2 has gripping elements 10, 11 embedded in the plastic, the upper gripping element 10 offering a relatively large gripping surface 12, whilst the lower gripping element 11 offers a somewhat smaller gripping surface 13. The gripping elements are preferably made from an elastomer and can additionally be provided on their free surface with a friction-increasing profile, e.g. in the form of grooves 14, which preferably run in closed, concentric ovals and are therefore adapted to the shape of the fingertip.

To the head 1 of the plastic brush body are fixed, e.g. welded, moulded in or anchored in some other way bristle bundles 15. The bristle bundles are arranged in several parallel rows in the direction of the brush body and also transversely thereto, but optionally can be mutually displaced. The bristle bundles can be of different length and can have random round, oval or polygonal cross-sections. Individual bristles within a bundle or individual bundles can have a different hardness or bending stiffness, e.g. different diameters or can be made from plastic having different bending stiffness characteristics.

The bristles of certain bundles 15 and preferably all the bundles, have different lengths within the bundle, so that their free ends are located on a conical envelope surface 16. The cone angle $\alpha$ scan be in the range 30 to 90 and preferably 50 to 70°.

Figure 2:
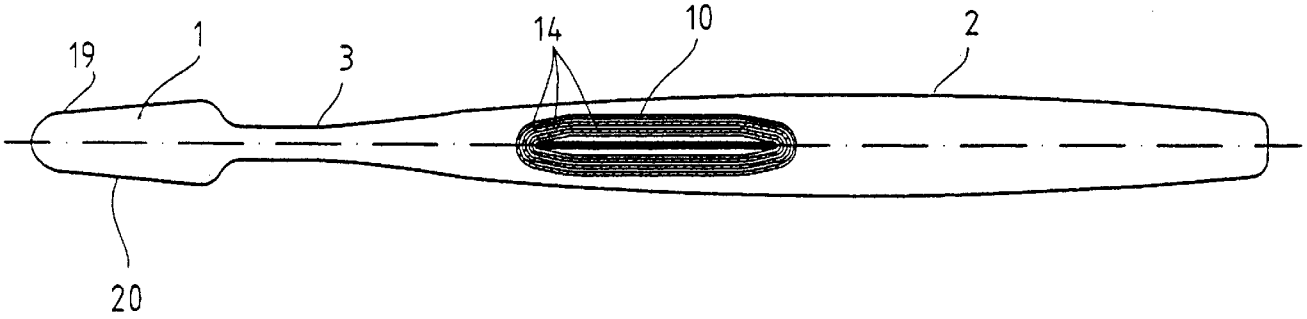
FIG. 2 A plane view of the toothbrush of FIG. 1.
Figure 4:
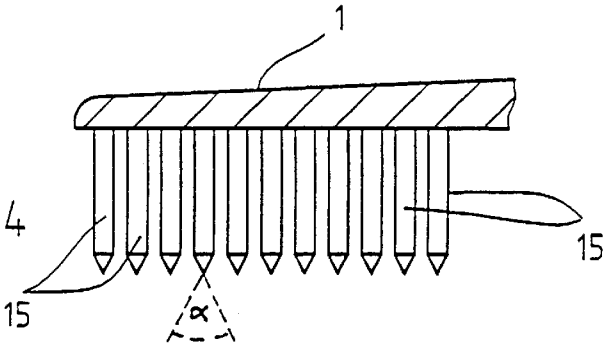
FIG. 4 A larger scale view in the vicinity of the toothbrush head.

The head 1 receiving the bristle bundles 15 is given a wedge-shaped construction in the plane of FIG. 1. Thus, the top 17 and bottom 18 approach one another towards the head end in wedge-shaped manner. In the plane perpendicular thereto and which is shown in FIG. 2, the head tapers conically, as revealed by the lateral faces 19, 20.

When using the toothbrush the head 1 can give way due to the spring action of the neck 3. The spring action is set in such a way that the head 1, in the case of an application force K between 500 and 1200 grams, can resiliently give way as a function of the size of the cone angle $\alpha$. The smaller the cone angle $\alpha$, the higher the application force K can be set. For the preferred range $\alpha$=50 to 70°, it is preferably between 700 and 900 grams.

Figures 5, 6, 7, 8:
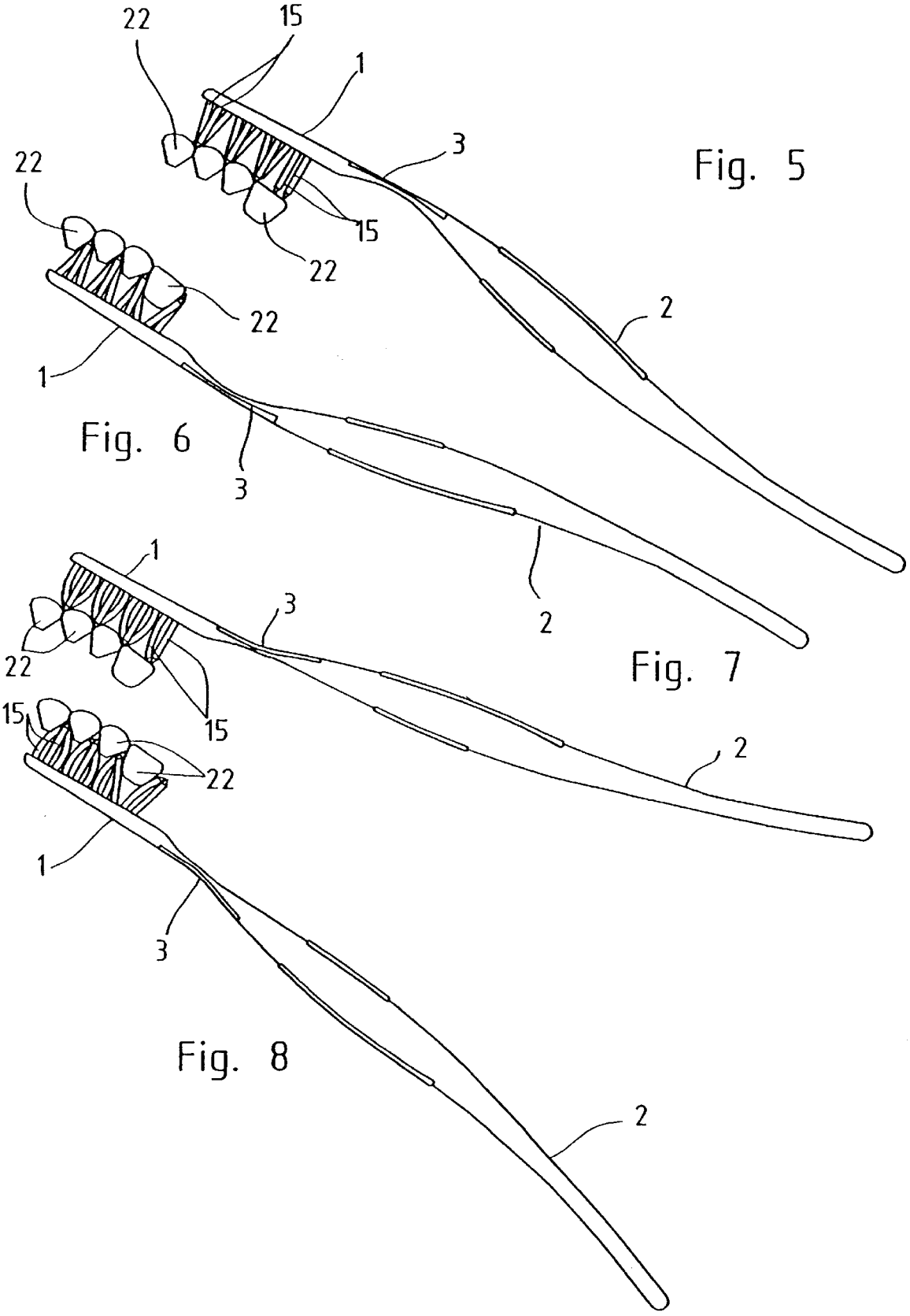
FIG. 5 A diagrammatic detail of the front tooth area during the cleaning of the front of the teeth.
FIG. 6 A detail corresponding to FIG. 5 when cleaning the back of the teeth.
FIGS. 7 & 8 In each case a view corresponding to FIGS. 5 and 6 on exceeding the permitted application force.

FIGS. 5 to 8 show the toothbrush in a use phase in the front tooth area of the denture. Reference numeral 22 designates tooth positions 1/2/3/4. FIG. 5 shows the cleaning process for the outside of the teeth 2, FIG. 6 when cleaning the inside. It becomes clear that during the cleaning process and largely independent of the brush guidance, the conical bristle bundles are moved into the interdental spaces, where they exert their cleaning action, but also work the tooth surfaces in the case of a slight raising of the toothbrush. However, when brushing the gingiva (not illustrated), the bristles do not or only slightly give way, so that all the bundles have a massaging action. However, if the pressure becomes excessive, as shown in FIGS. 7 and 8, the neck 3 of the brush body resiliently gives way and consequently so does the head, so as to prevent damage to the tooth and injury to the gums.

Figure 9:
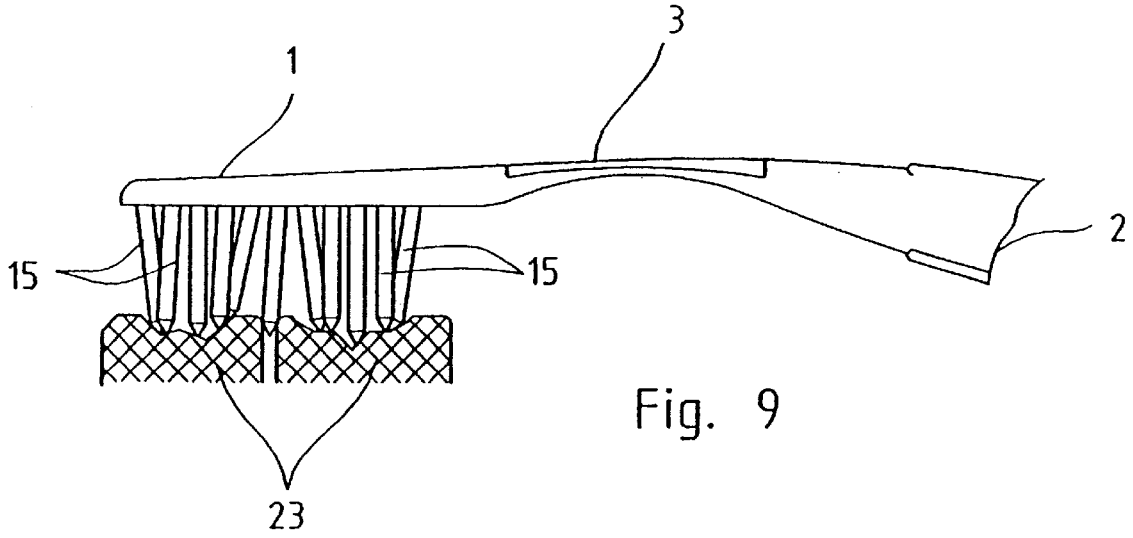
FIG. 9 A detail from the molar tooth area when cleaning the masticatory surfaces.
Figure 10:
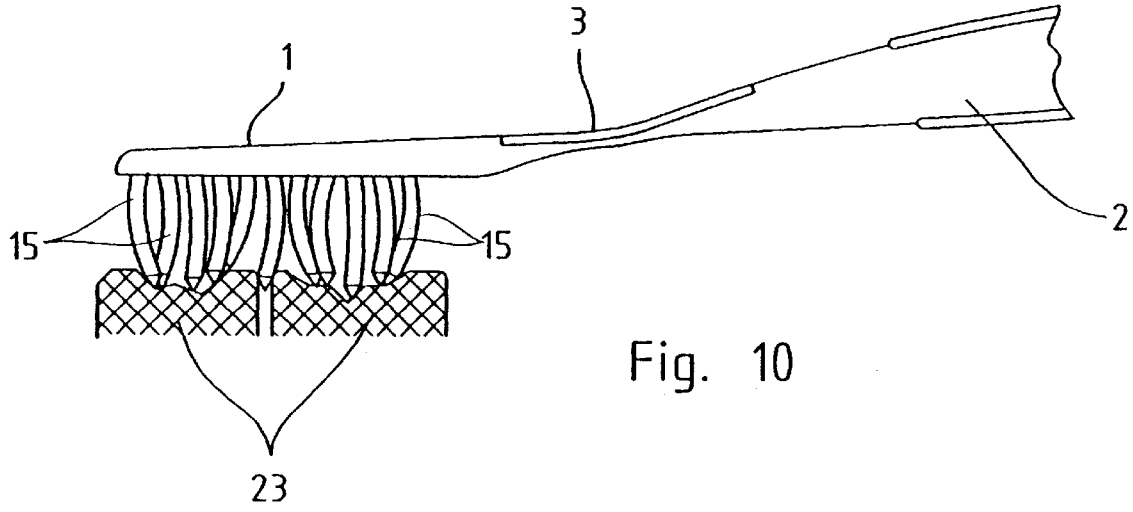
FIG. 10 A view corresponding to FIG. 9 on exceeding the permitted pressing force.

FIGS. 9 and 10 show a cleaning phase with respect to the masticatory surfaces of the molar teeth 23. Here again the conical bristle bundles enter the depressions of the masticatory surface and the interdental space. During the cleaning process there is a continuous change to the bristle setting angle, so that the entire masticatory surface is effectively cleaned. On increasing the application force K the bristle bundles 15 bend through (FIG. 10) and finally the neck gives way when an application force matched to the cone angle of the bristle bundles is exceeded.

What is claimed is:

1. A toothbrush comprising:

a plastic brush body having a head, a neck, a handle and bundles of bristles fixed to the head, free ends of the bristles of at least part of the bundles being located on an approximately conical envelope surface with a cone angle a in a range between 30 to 90° and wherein the neck only resiliently gives way when application occurs of a force K to the neck within a range of 500–1200 grams acting on the bristles to press the free ends against teeth, and the force K being inversely proportional to the cone angle $\alpha$.

2. A toothbrush according to claim 1, wherein:

the cone angle $\alpha$ is in the range between 50 to 70° and the resilient neck only gives way when the force K ranges between 700 and 900 grams.

3. A toothbrush according to claim 2, wherein:

the free ends of the bristles are spherical.

4. A toothbrush according to claim 2 wherein:

the free ends of the bristles are hemispherical.

5. A toothbrush according to claim 2, wherein:

the force K is a function of cross-section of the neck and/or choice of the plastic of the brush body and/or by a spring located on the neck.

6. A toothbrush according to claim 1, wherein:

the free ends of the bristles are spherical.

7. A toothbrush according to claim 1 wherein:

the free ends of the bristles are hemispherical.

8. A toothbrush according to claim 1, wherein:

the bundles of bristles have a circular, oval or polygonal cross-section.

9. A toothbrush according to claim 1, wherein:

the bristles have different hardnesses.

10. A toothbrush according to claim 1, wherein:

the force K is a function of cross-section of the neck and/or choice of the plastic of the brush body and/or by a spring located on the neck.

11. A toothbrush according to claim 1, wherein:

the head tapers in wedge-shaped manner or conically in a direction toward an end of the head.

* * * * *